US011512823B2

(12) United States Patent
Schreiber et al.

(10) Patent No.: US 11,512,823 B2
(45) **Date of Patent: *Nov. 29, 2022**

(54) SYSTEM FOR CREATING AN ILLUSION OF A SKYLIGHT

(71) Applicant: The Sky Factory, Fairfield, IA (US)

(72) Inventors: Radim Schreiber, Fairfield, IA (US); Skye Witherspoon, Fairfield, IA (US)

(73) Assignee: The Sky Factory, LC, Fairfield, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/503,532

(22) Filed: Oct. 18, 2021

(65) Prior Publication Data

US 2022/0034459 A1 Feb. 3, 2022

Related U.S. Application Data

(63) Continuation of application No. 16/188,197, filed on Nov. 12, 2018, now Pat. No. 11,149,910, which is a (Continued)

(51) Int. Cl.

| | |
|---|---|
| ***F21S 8/02*** | (2006.01) |
| ***F21S 8/06*** | (2006.01) |
| ***E04B 9/32*** | (2006.01) |
| ***F21V 3/00*** | (2015.01) |
| ***F21V 21/04*** | (2006.01) |

(Continued)

(52) U.S. Cl.

CPC ..... *F21S 8/026* (2013.01); *E04B 9/32* (2013.01); *F21S 8/061* (2013.01); *F21V 3/00* (2013.01); *F21V 21/049* (2013.01); *F21V 33/006* (2013.01); *E04B 9/006* (2013.01); *E04B 9/242* (2013.01); *F21W 2121/00* (2013.01); *F21W 2121/008* (2013.01); *F21W 2131/205* (2013.01);

(Continued)

(58) Field of Classification Search

CPC .. F21S 8/026; F21S 8/061; E04B 9/32; E04B 9/006; E04B 9/242; F21V 3/00; F21V 21/049; F21V 33/006; F21W 2121/00; F21W 2121/008; Y10S 362/806; Y10S 362/812

USPC ..... 362/97.4, 148, 406

See application file for complete search history.

(56) References Cited

U.S. PATENT DOCUMENTS 2,772,742 A 12/1956 Sprankle
2,861,173 A 11/1958 Nordquist (Continued)

OTHER PUBLICATIONS

Alleged brochure of Crownlite Mfg. Corp., Bohemia, L.I., N.Y., Copyright 1982, showing "Vertical Regressed Coffer Adapter". Applicant makes no admission of prior art or the truth or accuracy of the statements made concerning the attached document.

(Continued)

*Primary Examiner* — Laura K Tso

(74) *Attorney, Agent, or Firm* — Simmons Perrine Moyer Bergman PLC

(57) ABSTRACT

A system and method for creating a trompe-l'oeil skylight in a ceiling where a light emitting image of the sky is provided in a structure configured to emulate a skylight frame, including an embodiment of a unified non-rectangular sky image area in a substantially rectangular fixture which mount as a single unit into a substantially rectangular hole in a ceiling.

20 Claims, 8 Drawing Sheets

Related U.S. Application Data continuation of application No. 14/865,137, filed on Sep. 25, 2015, now Pat. No. 10,125,932, which is a continuation of application No. 14/507,531, filed on Oct. 6, 2014, now Pat. No. 9,146,011, which is a continuation of application No. 13/159,035, filed on Jun. 13, 2011, now Pat. No. 8,851,700, which is a continuation of application No. 12/342,833, filed on Dec. 23, 2008, now Pat. No. 7,959,316, which is a continuation of application No. 10/908,940, filed on Jun. 1, 2005, now Pat. No. 7,481,550.

(51) Int. Cl.

| | |
|---|---|
| ***F21V 33/00*** | (2006.01) |
| ***E04B 9/00*** | (2006.01) |
| ***E04B 9/24*** | (2006.01) |
| ***F21W 121/00*** | (2006.01) |
| ***F21Y 113/00*** | (2016.01) |
| ***F21W 131/205*** | (2006.01) |

(52) U.S. Cl.

CPC ..... *F21Y 2113/00* (2013.01); *Y10S 362/806* (2013.01); *Y10S 362/812* (2013.01)

(56) References Cited

U.S. PATENT DOCUMENTS

| | | | | |
|---|---|---|---|---|
| 4,188,656 | A | 2/1980 | Howard | |
| 4,932,170 | A | 6/1990 | Spear | |
| 5,426,879 | A | 6/1995 | Hecker | |
| 6,402,349 | B1 | 6/2002 | Miller et al. | |
| 6,870,673 | B2 | 3/2005 | Cromer et al. | |
| 7,481,550 | B1 | 1/2009 | Schreiber et al. | |
| 7,959,316 | B1 | 6/2011 | Schreiber et al. | |
| 8,096,671 | B1 | 1/2012 | Cronk et al. | |
| 8,851,700 | B1 | 10/2014 | Schreiber et al. | |
| 9,146,011 | B2 | 9/2015 | Schreiber et al. | |
| 10,125,932 | B2 | 11/2018 | Schreiber et al. | |
| 11,149,910 | B1 * | 10/2021 | Schreiber | E04B 9/32 |
| 2006/0023460 | A1 | 2/2006 | Steier et al. | |
| 2007/0008729 | A1 | 1/2007 | Tarpo | |
| 2010/0027255 | A1 | 2/2010 | Chang et al. | |
| 2015/0043199 | A1 | 2/2015 | Schreiber et al. | |

OTHER PUBLICATIONS

Document dated Oct. 20, 2010, giving an opinion of someone who does not speak for the applicant, the applicants assignee, or its attorneys or agents.

* cited by examiner

SYSTEM FOR CREATING AN ILLUSION OF A SKYLIGHT

CROSS-REFERENCE TO RELATED APPLICATION

This application is a continuation from an application filed on Nov. 12, 2018, with an application Ser. No. 16/188,197; which application was a continuation from an application filed on Sep. 25, 2015, with an application Ser. No. 14/865,137, now U.S. Pat. No. 10,125,932 issued on Nov. 13, 2018; which is a continuation from an application filed Oct. 6, 2014, with an application Ser. No. 14/507,531, now U.S. Pat. No. 9,146,011 issued on Sep. 29, 2015; which is a continuation from an application filed on Jun. 13, 2011, with an application Ser. No. 13/159,035, now U.S. Pat. No. 8,851,700 issued on Oct. 7, 2014; which is a continuation-in-part from an application filed on Dec. 23, 2008, with an application Ser. No. 12/342,833, now U.S. Pat. No. 7,959,316 issued on Jun. 14, 2011; which is a continuation of application Ser. No. 10/908,940 filed on Jun. 1, 2005, now U.S. Pat. No. 7,481,550 issued on Jan. 27, 2009, by the same inventors, with the same title as the within application.

FIELD OF THE INVENTION

The present invention generally relates to methods and systems for creating an illusion of a skylight.

BACKGROUND OF THE INVENTION

In recent years, medical professionals have used various types of methods to calm a patient who is undergoing or waiting for an important medical procedure. One example is the use of a skylight so the patient can have a view of the outdoors. While this is often very effective at helping to pacify a nervous patient, it is often not practical, especially in interior spaces without roof exposure or in shielded spaces used for radiological imaging or diagnostic equipment which often is required to be in completely enclosed and controlled areas. Other examples of needs for creating an illusion of a skylight exist as well.

One prior art method of pacifying a patient has been to create a trompe-l'oeil skylight by using translucent panels of an image of the sky and deploying them as a diffuser panel of the type typically placed in the grid below a fluorescent lamp used in a hung ceiling.

Such systems have been used extensively in the past and have positive characteristics, such as the ability to easily remove the translucent panel so as to allow for replacement of backlight lamps, etc. and the ability to eliminate the need for a drop-down door and the concomitant increase in mullion width that is caused by use of drop-down doors. These prior art systems do have several drawbacks. While they do tend to create a more pleasant environment, they often fail to trick the eye into believing it is a real skylight, and they often exhibit unwanted shadows created by the T-bar in the hung ceiling grid.

In the past it has been difficult to make a trompe-l'oeil skylight which has a shape which is generally non-rectangular.

Consequently, there exists a need for improved methods and systems for creating an illusion of a skylight.

SUMMARY OF THE INVENTION

It is an object of the present invention to provide, in a cost-efficient manner, a system and method for creating an illusion of a skylight.

It is a feature of the present invention to utilize an elevator frame configured to raise a translucent panel above the typical T-bar of a hung ceiling.

It is another feature of the present invention to provide an elevator frame which creates an illusion of a typical frame in a casement window or skylight.

It is an advantage of the present invention to achieve improved realism in the illumination of the panel in that shadows cast by the T-bar are eliminated.

It is another advantage of the present invention to provide the illusion of a casement-type window frame.

It is another advantage of the present invention to provide for the ability to easily and cost efficiently implement a trompe-l'oeil skylight in a hung ceiling system where the trompe-l'oeil skylight appears to be made of a different material than the ceiling grid.

It is another object of the present invention to improve trompe-l'oeil skylights which appear to have a non-rectangular shape.

It is another feature of the present invention to include a unified recessed trompe-l'oeil skylight having a non-rectangular shape with a rectangular shaped flush intermediate plate extending to the skylight.

It is another feature of the present invention to provide a skylight without an internal grid system.

The present invention is an apparatus and method for providing a trompe-l'oeil skylight which is designed to satisfy the aforementioned needs, provide the previously stated objects, include the above-listed features, and achieve the already articulated advantages. The present invention is carried out in a "T-bar shadow-less" manner in a sense that the shadows cast on a translucent image panel by T-bar ceiling grid members, have been eliminated. The invention is also accomplished in "trompe-l'oeil" manner in the sense that the appearance of the elevator frame in combination with the lower grid member tricks the eye of the observer into believing it is a casement-type skylight. The invention is also carried out in a unified structure approach in the sense that a non-rectangular skylight is unified with a rectangular flush mounting frame.

Accordingly, the present invention is a system and method including an elevator frame having a protuberance thereon for restricting horizontal movement of a translucent image panel while it is resting on the elevator frame which is being supported by a T-bar grid system of a hung ceiling and also is a system for combining a rectangular flush to the ceiling plate in combination with a recessed non-rectangular skylight fixture.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
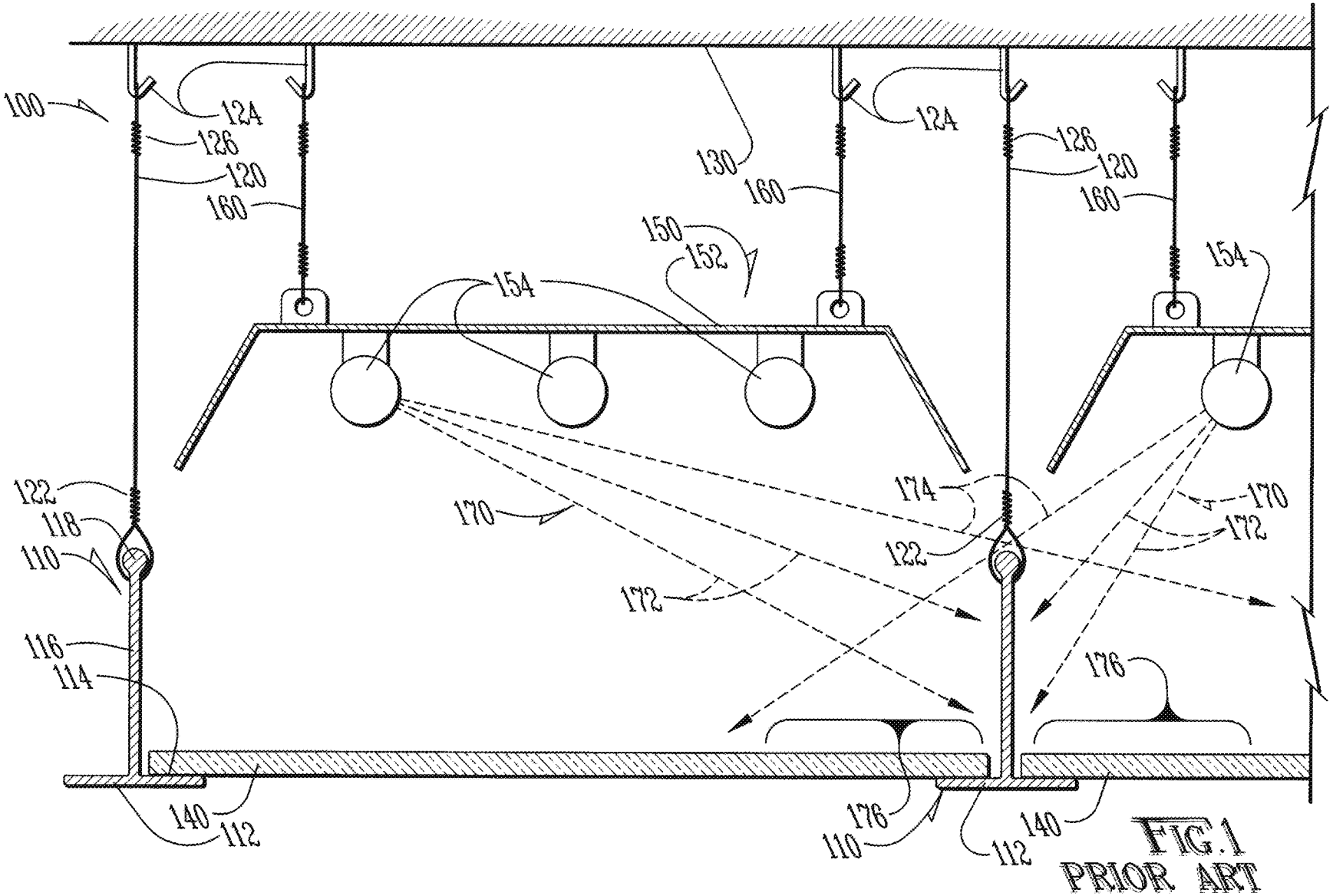
FIG. 1 PRIOR ART
FIG. 1 is an elevation or side view of a prior art hung ceiling system with an illuminated panel.

Now referring to the drawings wherein like numerals refer to like matter throughout, and more specifically referring to FIG. 1, there is shown a side view of a hung ceiling system of the prior art generally designated 100 which includes a translucent sky image panel 140. This end view or cross-sectional view is of a translucent sky image panel disposed with a T-bar grid member 110 on each side. The T-bar grid member 110 is a long linear T-shaped element which has a T-bar grid member bottom surface 112 which is visible to the consumer along with other translucent sky image panels 140 and other ceiling tiles (not shown). T-bar grid member 110 has a T-bar grid member bottom shelf 114 where the translucent sky image panel 140 or a regular ceiling tile would rest. T-bar grid member 110 has a T-bar grid member vertical member 116 and a T-bar grid member top portion 118 which is coupled to a T-bar suspension wire 120 by a T-bar suspension wire bottom winding 122. T-bar suspension wire 120 is often attached at intervals larger than the length of the ceiling tiles and the translucent sky image panel 140. T-bar suspension wire 120 is shown coupled to a hidden ceiling coupling device 124 by a T-bar suspension wire top winding 126. Variations of this prior art system are well known in the art. The translucent sky image panel 140 is backlit by a backlight fixture 150 having a reflector 152 and a group of backlight lamps 154. Backlight fixture 150 is hung from the hidden ceiling 130 via backlight fixture suspension wires 160 in a well-known manner. One common detail of this system is that a gap exists between the numerous T-bar grid members 110 and the bottom of the reflector 152. This allows a panel to be inserted in a space above the T-bar grid member 110 and then manipulated and then let back down onto the T-bar grid member bottom shelf 114.

Backlight fixture 150 emits light in many directions; however, only a portion of the light rays emanating from the backlight lamps 154 are shown. Selected light rays 170 are shown to be directed generally toward a T-bar grid member 110. It can be seen that blocked light rays 172 are unable to reach a translucent sky image panel 140 in an adjacent section because of the optical barrier created by the presence of T-bar grid member 110. Non-blocked inter-panel light rays 174 is shown to depict light from one section of a ceiling which tends to provide part of the illumination of a translucent sky image panel 140 which is not directly below the source of the non-blocked inter-panel light rays 174. A partially shaded region 176 area occurs if the T-bar grid member 110 blocks the blocked light rays 172. These partially shaded regions 176 are on both sides of the T-bar grid member 110. T-bar grid members 110, which are perpendicular to the two T-bar grid members 110 shown, also are used to support translucent sky image panels 140 and other ceiling tiles. These perpendicular grid components also tend to make partially shaded areas as well.

Figure 2:
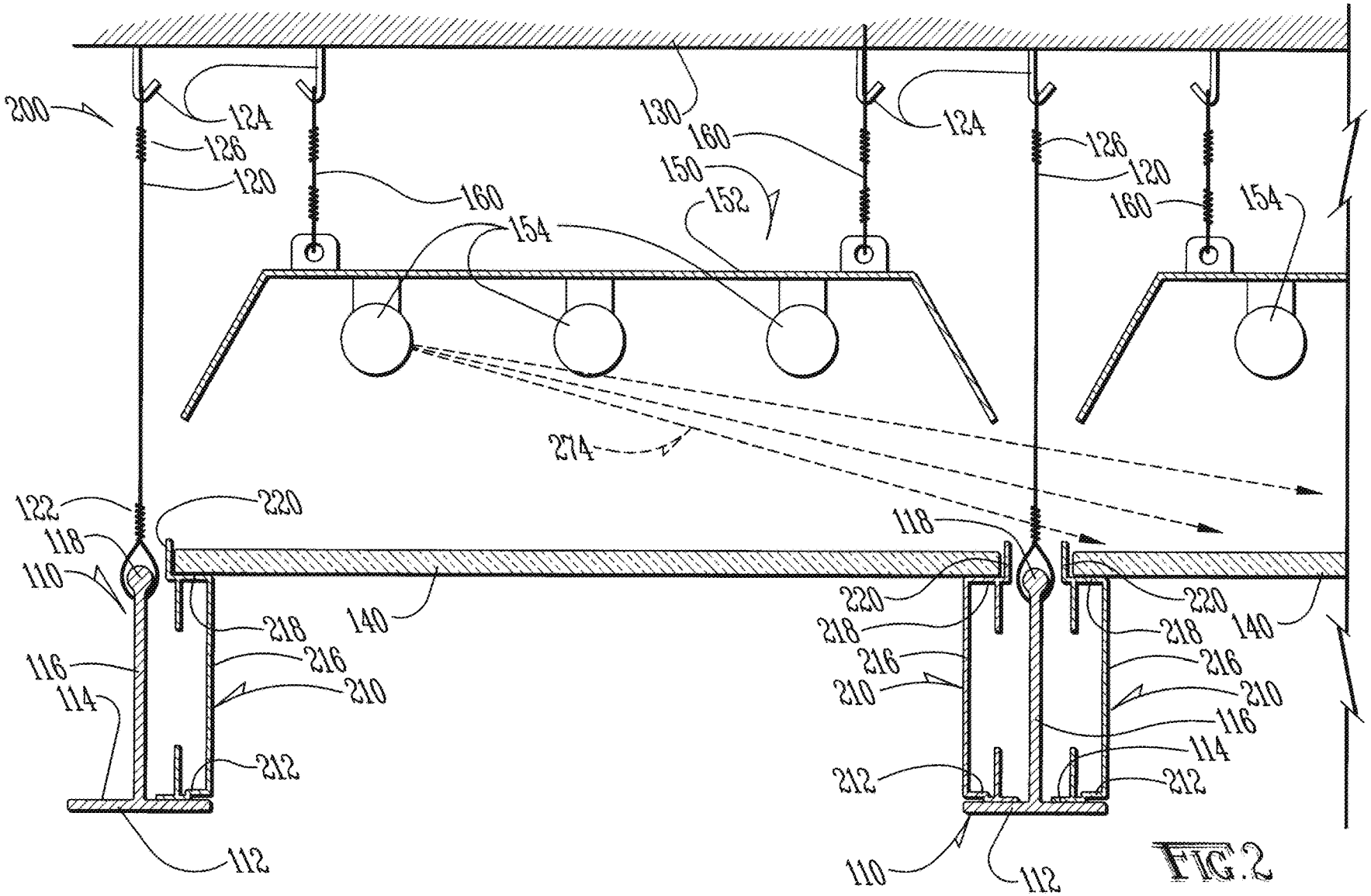
FIG. 2 is a side or elevation view of the system of the present invention which includes a panel elevating frame disposed within a prior art hung ceiling system grid.

Now referring to FIG. 2, there is shown a side view of the hung ceiling system of the present invention generally designated 200, which includes the panel elevating frame 210, which raises the translucent sky image panel 140 above the T-bar grid member 110. Panel elevating frame 210 may be made of a material similar to T-bar grid member 110, or it may be made of other suitable materials as well. Often light-weight materials, such as aluminum, are preferred. In some embodiments of the present invention, panel elevating frame 210 may be made of wood and a trim piece of a matching wood is placed over the T-bar grid member bottom surface 112, thereby creating an illusion of a wood casement window frame. Panel elevating frame 210 is shown having a panel elevating frame bottom surface 212 which rests upon T-bar grid member bottom shelf 114. Panel elevating frame 210 has a visible interior surface panel elevating frame vertical section 216 and a panel elevating frame top shelf 218 which is not visible from underneath by a typical viewer. Panel elevating frame top shelf 218 has a panel elevating frame slide limiting protuberance 220 disposed thereon to help limit the amount of sliding that can occur between translucent sky image panel 140 and the panel elevating frame top shelf 218. The distance between two panel elevating frame slide limiting protuberances 220 on opposing sides of a single translucent sky image panel 140 is greater than the width of the translucent sky image panel 140, while the distance between two panel elevating frame vertical sections 216 on opposing sides of the translucent sky image panel 140 is less than the width of the translucent sky image panel 140. Panel elevating frame 210 is preferably a rectangular frame which rests on the T-bar grid member bottom shelf 114 of the various T-bar grid members 110 which surround a translucent sky image panel 140 when it is in place in the ceiling. The perpendicular sections of panel elevating frame 210 are not shown in the FIG. 2.

Backlight lamps 154 are shown having light rays 274 which illuminate an adjacent panel and are not blocked by the T-bar grid member 110. The T-bar suspension wire 120 can cause some minor shadowing, but since the thickness of a T-bar suspension wire 120 is much smaller than the length of a T-bar grid member 110, the amount of shading at the edge of a translucent sky image panel 140 caused by the T-bar suspension wires 120 is insignificant in comparison to the amount of edge shading that results from a T-bar grid member 110 when it is used without the panel elevating frame 210 of the present invention.

Figure 3:
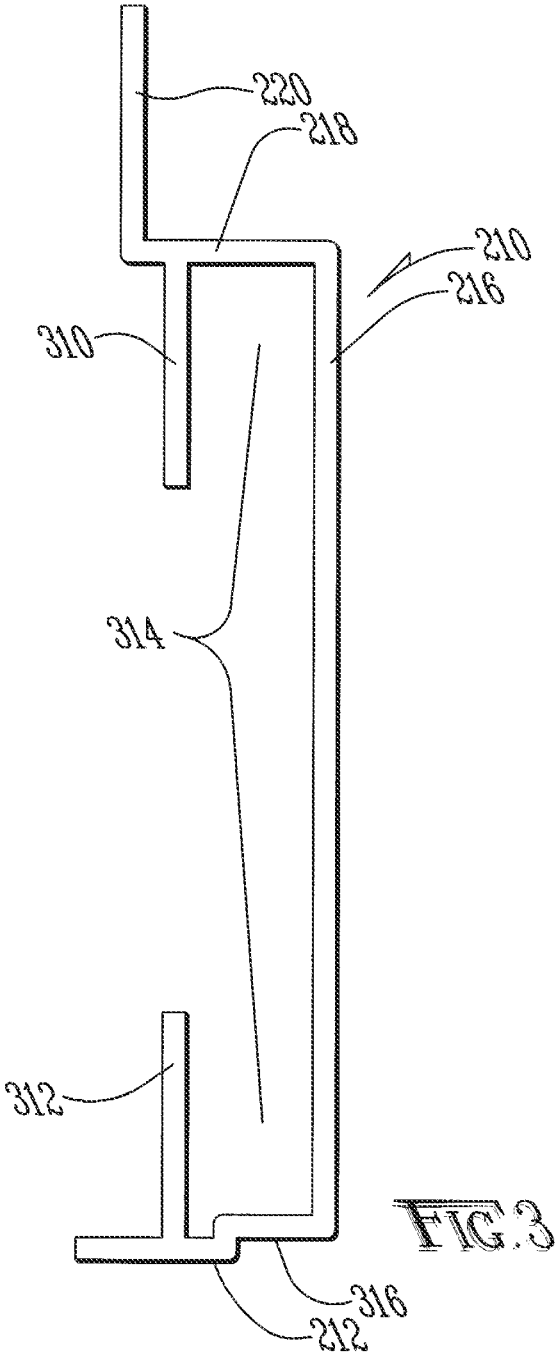
FIG. 3 is a close cross-sectional view of one side of the panel elevating frame of the present invention.

A more detailed understanding of the present invention can be achieved by now referring to FIG. 3, which shows a cross-sectional view of one piece of the panel elevating frame 210 which shows the visible inside surface panel elevating frame vertical section 216 and top-angled corner piece retaining member 310 and bottom angled corner piece retaining member 312. Angle corner piece receiving gap 314 is the gap between the top angled corner piece retaining member 310 and the non-visible side of panel elevating frame vertical section 216 and the gap between bottom-angled corner piece retaining member 312 and the non-visible side of panel elevating frame vertical section 216. Panel elevating frame 210 may be an extruded aluminum piece and top-angled corner piece retaining member 310 and bottom-angled corner piece retaining member 312 may be merely sections of an elongated section of panel elevating frame 210. The angle corner piece receiving gap 314 is made to secure with a friction fit an angled corner piece 410 of FIG. 4. There is shown a bottom inside recess 316 which is provided for accommodation of the extra thickness of the rolled back grid edge of standard ceiling grid.

Figure 4:
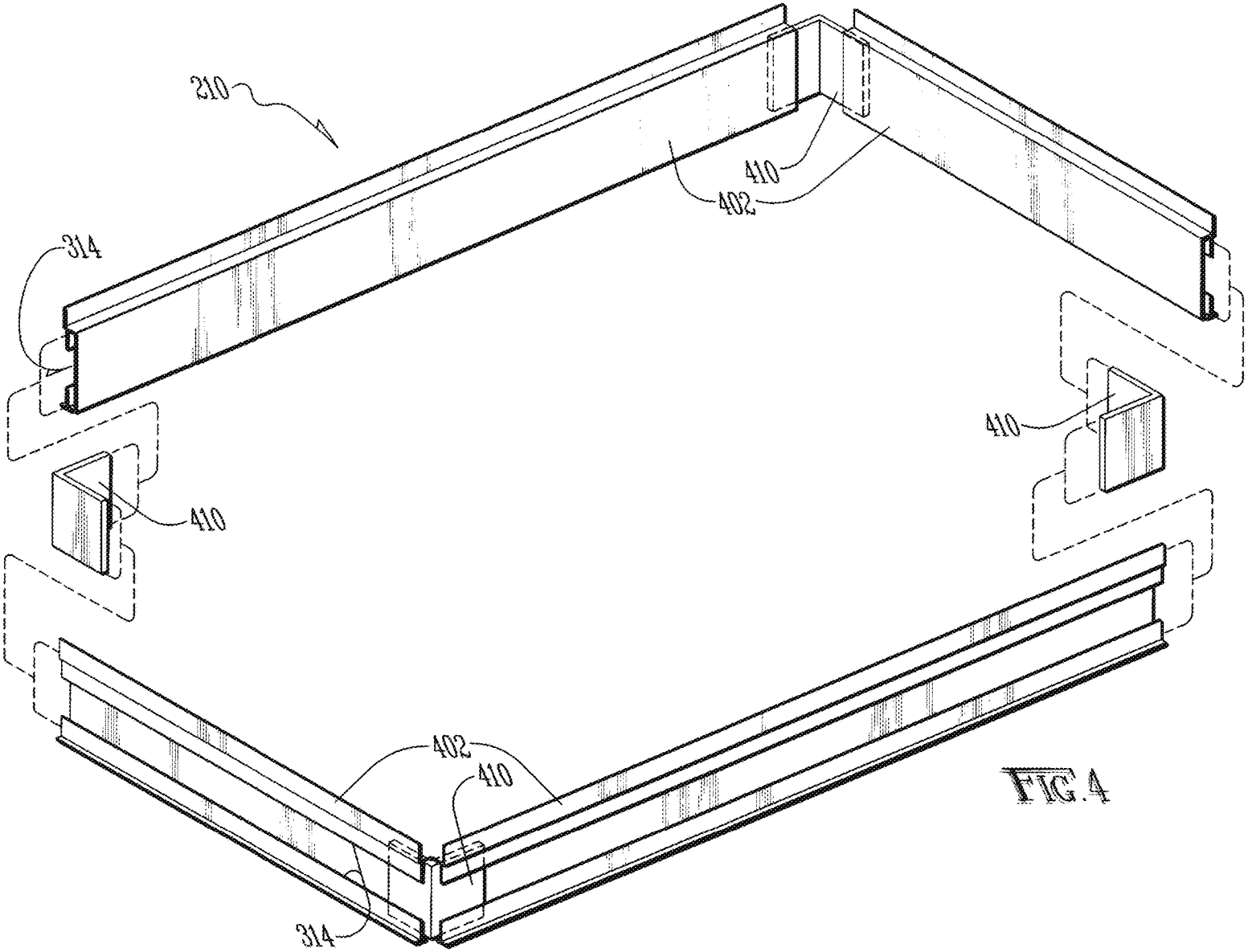
FIG. 4 is an exploded view of a panel elevating frame of the present invention.

An even more detailed understanding of the present invention may be achieved by now referring to FIG. 4, which shows an exploded view of the panel elevating frame 210 of the present invention with four individual sections 402 of the panel elevating frame 210. Each section 402 is coupled at each end to two other sections 402 by angled corner pieces 410. The angled corner pieces 410 are an aluminum material which is capable of retaining the preferably rectangular shape and are inserted into the angle corner piece receiving gap 314 in the end of each section 402 as shown, thereby creating a rectangular panel elevating frame 210. In the case of a wood system, various traditional methods of joining corners to insure a rigid 90-degree corner can be used.

Figure 5:
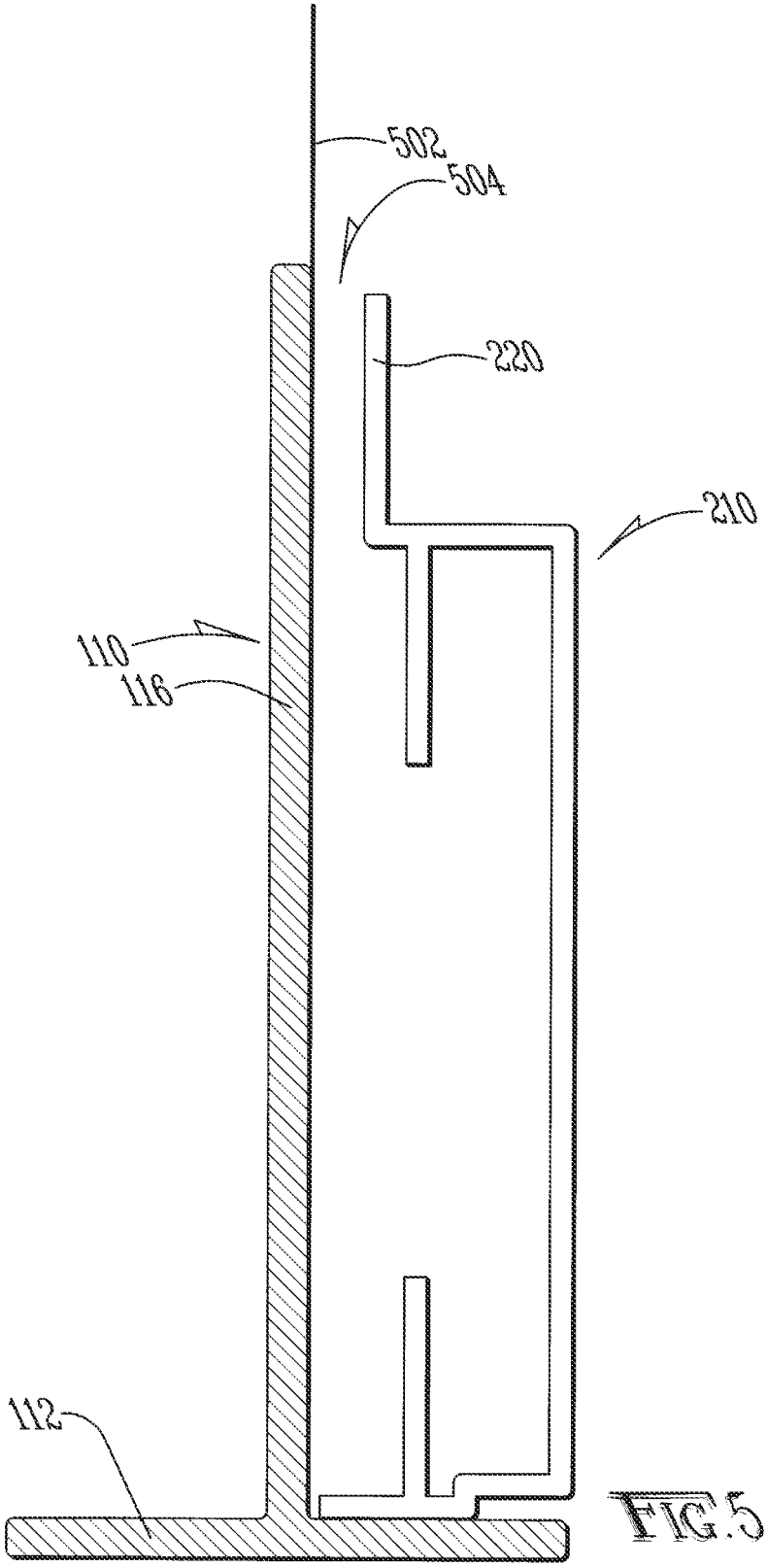
FIG. 5 is an additional side view of the panel elevating frame of the present invention where an end cap of a light box is disposed between the panel elevating frame and the T-bar grid member.

Now referring to FIG. 5, there is shown a T-bar grid member 110 with a panel elevating frame 210 disposed thereon. Panel elevating frame 210 is shown separated from T-bar grid member vertical member 116 by an end cap wall receiving gap 504 with an end cap wall 502 disposed therein. The present invention can thereby accommodate backlight fixtures which utilize end caps to help provide support and help alignment of the backlight fixture with respect to the grid system.

Figure 6:
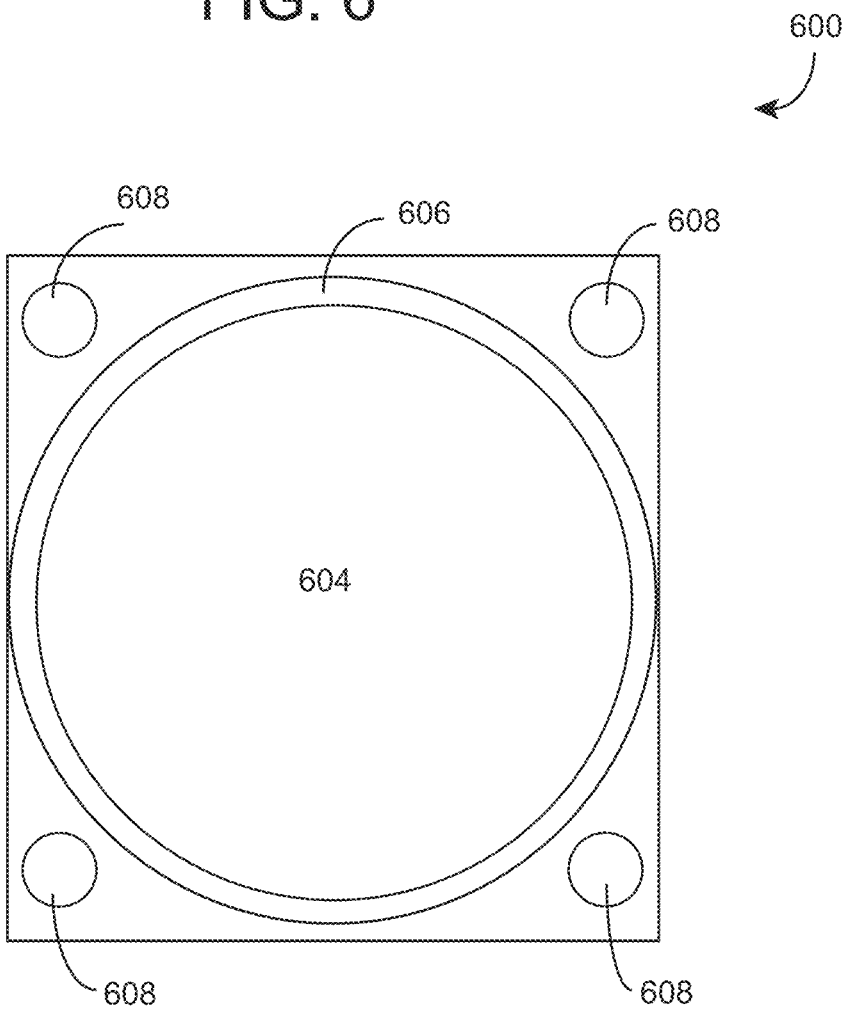
FIG. 6 is a plan drawing of a unified non-rectangular sky ceiling and rectangular surround with task lighting embodiment of the present invention.

Now referring to FIG. 6, there is shown a plan view of a rectangular trompe-l'oeil skylight fixture, generally designated 600 with a non-rectangular skylight image 604 therein with a rectangular surround 602. Disposed in corners of rectangular surround 602 is optional task lighting 608. Rectangular trompe-l'oeil skylight fixture 600 is preferably a unified structure that is placed, as a single object, into a void in a ceiling. Some trim or other border could be provided to make the gap between the ceiling and the rectangular trompe-l'oeil skylight fixture 600 more attractive. Non-rectangular skylight image 604 is a light emitting image of the sky and may be a backlight sky image panel, a video display, or any suitable display means to create a realistic sky image which appears like a skylight allowing light to enter the room. Non-rectangular skylight image 604 specifically excludes a simple non-translucent photographic of a sky image. Rectangular surround 602 is preferably a flat panel member which is designed to emulate a portion of a ceiling or a portion of a skylight surround. Non-rectangular skylight image 604 may be flush, recessed or protruding from rectangular surround 602. Trim ring 606 preferably is designed to emulate a frame around a skylight and may be made of any suitable material; however, materials often used for frames around skylights and window, such as wood, plastic, or metal, are all contemplated. Non-rectangular skylight image 604 is shown as circular, but other elliptical or non-rectangular shapes such as ovals or other closed curved or irregular shapes are contemplated as well. Trim ring 606 is shown in a special case as being circular, but preferably has the same shape as non-rectangular skylight image 604. Note that a substantially rectangular structure disposed behind trim ring 606, such as a typical LCD video display, should be understood to provide a non-rectangular skylight image 604 when viewed in conjunction with trim ring 606 which has a desired non-rectangular shape. Fixture 710 could be substituted with a CRT, Plasma, or any other display type that emits light and images.

Optional task lighting 608 can be recessed, flush or protruding and can provide ambient room light or light specific for a task or a combination of various lights.

Figure 7:
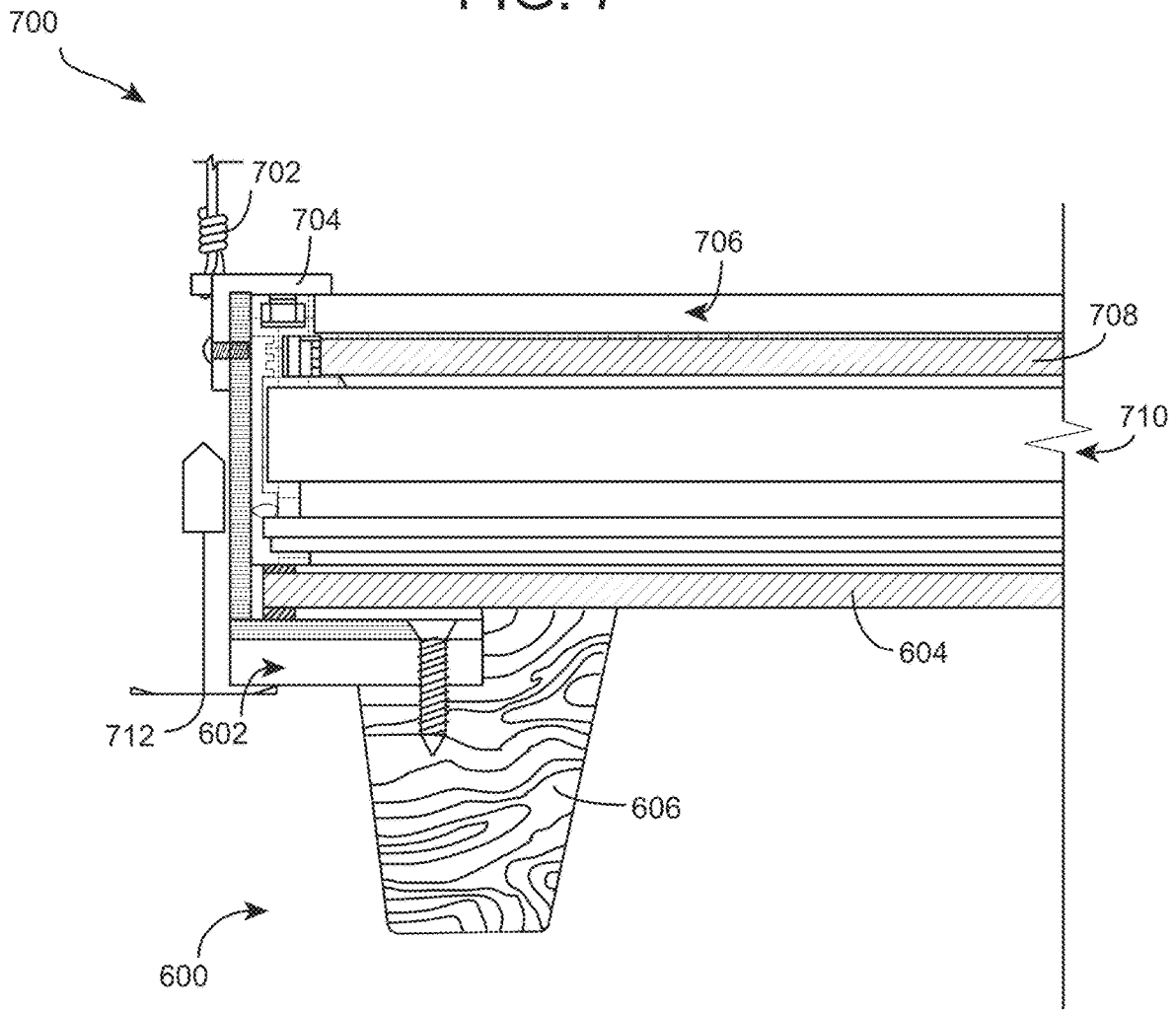
FIG. 7 is a detailed cross-sectional view of a unified non-rectangular sky ceiling and rectangular surround with task lighting embodiment of the present invention used in conjunction with a T-grid ceiling system.

Now referring to FIG. 7, there is shown a T-grid mounted, a T-grid rectangular trompe-l'oeil skylight fixture and environment generally designated 700 which includes a rectangular trompe-l'oeil skylight fixture 600 of the present invention, together with mounting structures. A ceiling hanger bracket 704 and support member 702 are shown to provide support from above. A unified rectangular trompe-l'oeil skylight fixture 710 is shown here as a static backlighted translucent image panel with an extruded aluminum frame 706 and a light guide panel 708, but video or other displays are also contemplated. Non-rectangular skylight image 604 is shown as a non-rectangular portion of a substantially rectangular image portion of fixture 710, which is shown as being supported from below by a T-grid ceiling system which is well known in the art.

Figure 8:
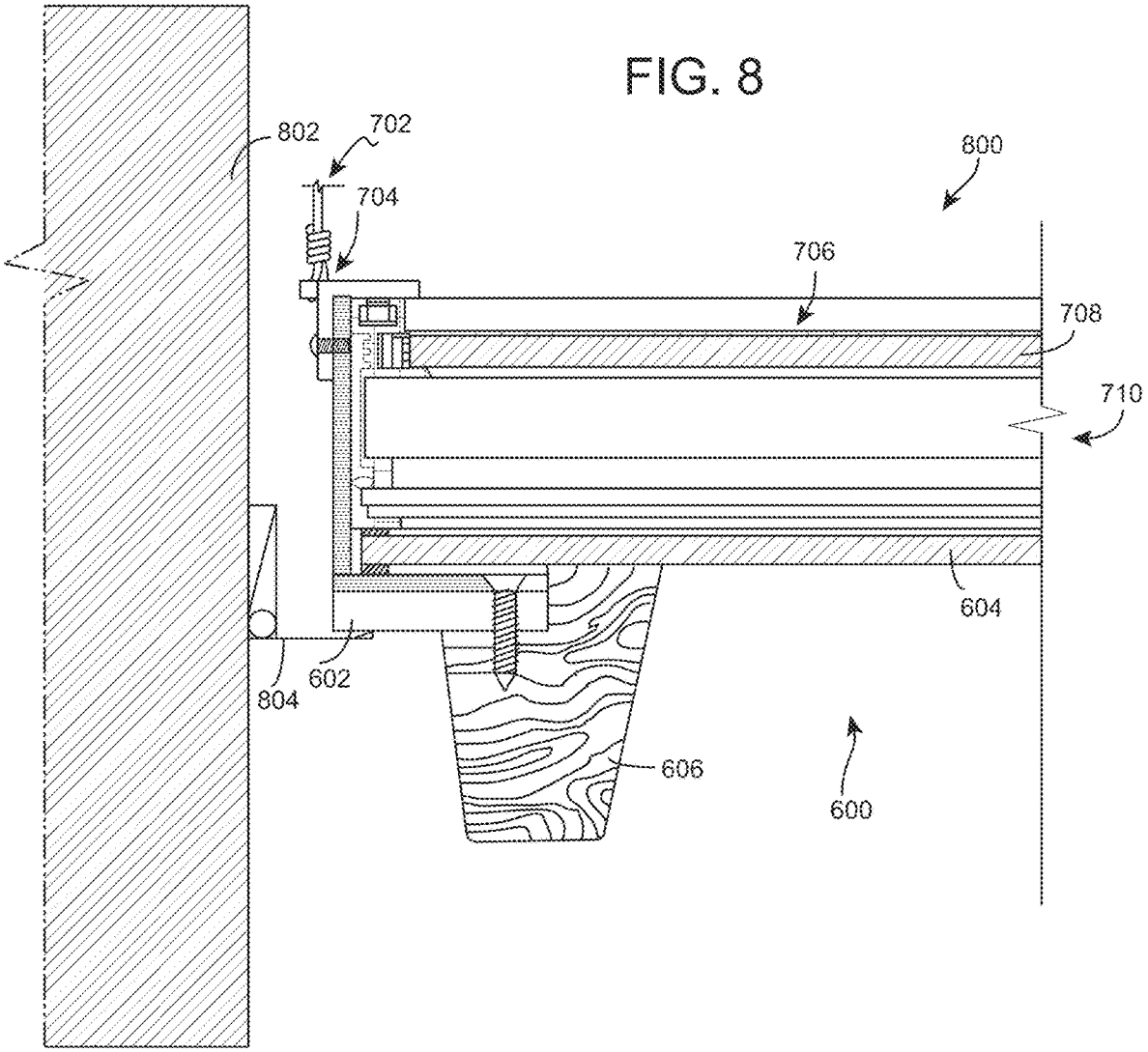
FIG. 8 is a detailed cross-sectional view of a unified non-rectangular sky ceiling and rectangular surround with task lighting embodiment of the present invention mounted in a non-T-grid structure.

Now referring to FIG. 8, there is shown a side or soffit mounted version of the system of FIG. 7, generally designated 800, where the T-grid 712 is replaced with a wall, ceiling or soffit board or support member 802 and a wall angle 804. Otherwise the system may be very similar to that of FIG. 7.

Throughout this description, reference is made to "translucent sky panel" or a "translucent sky image panel". It should be understood that this could refer to any type of panel which is made to create an appearance as if looking out a skylight up to the sky. These panels can include images of items other than clouds. They can include images of trees or other items which might help create an illusion of looking up through a skylight to the outdoors. The present invention is intended to cover all such items.

Throughout this description, reference is made to a patient. The present invention is intended to apply to any person for whom it is desirable to have a trompe-l'oeil skylight.

The term "trompe-l'oeil" is used herein to mean simulated so as to trick the eye.

The present invention is described in a preferred embodiment as being rectangular because it is believed that a rectangular ceiling grid is the most efficient. However, other shapes, including circular and oval, can be used as well.

While the description of the present invention herein has been largely focused upon, or otherwise assuming, the use of a standardized (2'×2' or 2'×4') grid system with translucent panels, it should be understood that the elevator concept of the present invention, with its ability to imitate the look of a group of skylights, could be employed with non-standardized grids and with panels other than translucent panels. In fact, the present invention could be implemented with custom-sized panels and with flat panel electronic displays, such as flat liquid crystal displays (LCDs), plasma displays, and other types of electronic video-type displays. In such cases, the group of several flat panel displays would be synchronized so as to appear to be one large image located behind a group of skylights, where the illusion of skylights is created by the innovative elevator element as used in the present invention to create an illusion of a group of skylights disposed above a normal hung ceiling.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A trompe-l'oeil skylight fixture system comprising:
a fixture for generating a sky illusion on a panel, the fixture comprising:
a fixture periphery forming a peripheral portion of said fixture;
said panel, having a viewing side and an illumination side;
a light source to illuminate said panel on said illumination side; and
a panel support member on said viewing side;
wherein said fixture is configured to be installed into a ceiling and said panel support member contacts said panel on a periphery of said panel.

2. The system of claim 1 wherein a horizontal panel elevating frame top shelf of said panel support member makes contact with said panel directly.

3. The system of claim 1 further comprising a frame configured to displace said fixture from said ceiling.

4. The system of claim 3 where said frame and said panel support member are not separate structures.

5. The system of claim 1 where said light source comprises a man-made light source.

6. The system of claim 5 wherein said man-made light source is a backlight lamp.

7. The system of claim 1 wherein said panel comprises an illusion of a sky.

8. The system of claim 7 further comprising a trim member disposed on said viewing side of said panel.

9. The system of claim 1 wherein said panel comprises a translucent panel.

10. The system of claim 1 wherein said ceiling is a horizontal ceiling.

11. A virtual skylight comprising:
a fixture for creating an illusion of a sky; and
a frame disposed adjacent to said fixture and further configured to displace vertically said fixture from a T-bar grid member; said frame defining a central region therein.

12. The system of claim 11 wherein said frame is disposed adjacent to said fixture and has a rectangular shape.

13. The system of claim 11 wherein said frame is an extruded frame.

14. The system of claim 13 where said extruded frame is an extruded metal frame.

15. The system of claim 14 wherein said extruded metal frame is aluminum.

16. The system of claim 11 wherein said fixture and said frame are independent and separable with respect to each other.

17. A system for generating an illusion of a sky portion; the system comprising:
a light-emitting fixture;
an architectural skylight effect creating spacer;
wherein said light-emitting fixture and said architectural skylight effect creating spacer are configured to be installed vertically on a T-bar grid member;
wherein said architectural skylight effect creating spacer contacts said light-emitting fixture on a periphery of said light-emitting fixture; and
wherein said light-emitting fixture emulates a sky.

18. The system of claim 17 wherein said architectural skylight effect creating spacer is rectangular extruded metal frame, which is independent and separable from said light emitting fixture; and wherein said T-bar grid member is a ceiling portion of a portion of a building structure.

19. A virtual skylight comprising:
a fixture for creating an illusion of a sky;
a frame disposed adjacent to said fixture and further configured to displace said fixture from a T-bar grid member; said frame defining a central region therein; and
said frame is a regressed frame.

20. The system of claim 19 where said illusion of a sky is provided by lighting a translucent panel.

* * * * *